US006577301B1

(12) United States Patent
Tsai et al.

(10) Patent No.: US 6,577,301 B1
(45) **Date of Patent: *Jun. 10, 2003**

(54) METHOD AND APPARATUS FOR REWRITING FUNCTIONS AND FONTS OF A MONITOR

(75) Inventors: Te-Hsiu Tsai, Taipei (TW); Kent Yin, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/543,008

(22) Filed: Apr. 4, 2000

(30) Foreign Application Priority Data

Dec. 16, 1999 (TW) ..... 88122129 A

(51) Int. Cl.[7] ..... G09G 5/00

(52) U.S. Cl. ..... 345/204; 345/552; 345/10; 345/205

(58) Field of Search ..... 345/10, 205, 551, 345/204

(56) References Cited

U.S. PATENT DOCUMENTS 6,295,053 B1 * 9/2001 Tsai et al. ..... 345/10

* cited by examiner

*Primary Examiner*—Joseph Mancuso
*Assistant Examiner*—Antonio Caschera
(74) *Attorney, Agent, or Firm*—J. C. Patents

(57) ABSTRACT

A method and an apparatus for rewriting functions and fonts of a monitor. When an erasable programmable read only memory for controlling the functions or fonts of a monitor is to be refreshed, using the VGA signal, the programming data or font data of a monitor controller is directly written into the erasable programmable read only memory to perform the refresh operation. Using the apparatus for rewriting the functions and fonts of a monitor, the normal vision path can be isolated to achieve the refresh of the erasable programmable read only memory. Compared to a conventional procedure to refresh erasable programmable read only memory that requires to open the enclosure of the monitor and to switch the monitor, the labor consumption is reduced and the operation is more convenient.

33 Claims, 7 Drawing Sheets

METHOD AND APPARATUS FOR REWRITING FUNCTIONS AND FONTS OF A MONITOR

CROSS-REFERENCE TO RELATED APPLICATION

This application claims the priority benefit of Taiwan application serial no. 88122129, filed Dec. 16, 1999.

BACKGROUND OF THE INVENTION

1. Field of the Invention

The invention relates in general to a method and an apparatus for rewriting functions and fonts of a monitor. More particularly, the invention relates to a method and an apparatus connected to a VGA card to achieve the rewriting operation of functions and fonts of a monitor via a VGA signal line.

2. Description of the Related Art

In a current monitor system, the monitor controller has to be switched while modifying the function or debugging the software, and thus consumes a lot of cost. In a more advanced monitor system, a read only memory including an erasable programmable read only memory is built in, so that by refreshing the read only memory, the modification of functions, software debugging or font alteration can be achieved.

FIG. 1 shows a block diagram for a circuit of conventional monitor function system. There are 8 VGA signal lines coupled to a VGA card, including a vertical synchronous signal line (Vsync), a horizontal synchronous signal line (Hsync), a serial data signal line (SDA), a serial clock signal line (SCL), a ground signal line (Gnd), a red signal line (R), a green signal line (G) and a blue signal line (B). Under the normal operation, a first jumper 24 connects the monitor controller 19 with the read only memory to the horizontal and vertical deflection apparatus 20. A second jumper 25 connects the monitor controller 19 with the read only memory to the on screen display circuit 50, and the power source jumper 23 connects the monitor controller 19 with the read only memory to 5V. The Hsync, Vsync, SDA, SCL and Gnd signals are coupled to the monitor controller 19 having the read only memory. According to the received signals and applying the program in the read only memory to drive the horizontal and vertical deflection apparatus 20, the vertical booster 30 and the horizontal booster 40 are controlled as the horizontal and vertical control of the CRT. On the other hand, the on-screen display circuit 50 is driven to control the image pre-amplifier to receive the R, G and B signals. Being pre-amplified, the signals are sent to the image amplifier 70, and displayed on the screen of the monitor.

When the functions of the monitor system is to be modified, the data of the read only memory in the monitor controller 19 is modified. This must be achieved by opening the enclosure of the monitor. The first and the second jumpers 24 and 25 are switched to connect the monitor controller 19 to the writing flat cable 80, and the power source jumper 23 connects the monitor controller 19 to 12V. The read only memory writer (indicated by the reference numeral 92 in FIG. 2) is coupled to the writing flat cable 80 to perform the new functions and new fonts of the monitor system.

FIG. 2 shows a block diagram of a conventional function rewritable monitor system. When the enclosure of the monitor 100 is opened, the writing flat cable 80 and the VGA signal lines 18 can be found on the monitor main circuit board 110. In the jumper area 22, the first, the second and the power source jumpers can be found and switched. The memory writing system 90 controls the read only memory writer 92 via the computer, and observes the writing status by the monitor 96. The read only memory writer 92 is coupled to the writing flat cable 80 to performing the rewriting by the computer, so as to achieve the refresh function of the monitor system.

To refresh the monitor system, conventionally, the enclosure of the monitor has to be opened to switch the jumpers to refresh the erasable programmable read only memory. It is very inconvenient and costs a lot of labor.

SUMMARY OF THE INVENTION

The invention provides an apparatus and a method for rewriting functions and fonts of a monitor. By directly using the VGA signal lines to transmit and write the programming data and fonts of the monitor controller to the electrical erasable programmable read only memory, the data refresh can be done.

The apparatus for rewriting functions and fonts of a monitor is briefly described as follows. The VGA signal lines are used to transmit write commands and write data. A detection apparatus is coupled to the VGA signal line. An activation apparatus is coupled to the detection apparatus to switch a vision path into a write path, and to receive the write data and the write data, so as to output the write commands and data from the write path. A read only memory write command decoding apparatus is coupled to the activation apparatus via the write path. The read only memory write command decoding apparatus judges the write command, so as to output the write commands and data while rewriting fonts. For function rewriting, the read only memory write command decoding apparatus transfers the write commands into erasable/read/write signals and the write data into address signals and data signals. A read only memory is coupled to the read only memory write command decoding apparatus, so as to refresh the data stored in the read only memory according to the address signals, the data signals and the erase/read/write signals.

A retrieving apparatus is coupled to the read only memory write command decoding apparatus and the activation apparatus to judge the refreshing status of the read only memory according to the address signals, the data signals and the erase/read/write signals. After refreshing, the write path is switched to the vision path by controlling the activation apparatus. A set of IIC circuit is coupled to the read only memory write command-decoding apparatus to receive the write commands and the write data while rewriting the fonts. An on-screen display circuit detection apparatus is coupled to the IIC circuit to detect and output the write commands and the write data. An on-screen display circuit activation apparatus is coupled to the on-screen display circuit detection apparatus to switch the signal path into the font write path, and to receive and output the write commands and the write data. The on-screen display circuit write command decoding apparatus couples the font write path to the on-screen display circuit activation apparatus. The on-screen display circuit write command decoding apparatus transfers the write commands into erase/read/write signals, and the write data into address signals and data signals. The on-screen display circuit font read only memory is coupled to the on-screen display circuit write command decoding apparatus to refresh the data stored in the monitor font read only memory according to the address signals, the data signals and the erase/read/write signals. An on-screen display circuit retrieving apparatus is coupled to the on-screen display circuit write command decoding apparatus and the on-screen display circuit activation apparatus, so as to judge the refreshing status of the read only memory according to the address signals, the data signals and the erase/read/write signals, and to switch the font write path into vision path by controlling the on-screen display circuit activation apparatus.

A method of rewriting functions and fonts of a monitor is also provided by the invention. In step (a), a comparison of a plurality of sequential series addresses is performed on a plurality of signals of a VGA signal line. A monitor in-system programming mode is set when the comparison of the sequential series addresses is correct in step (b). A write command is read and judged in step (c), when the write command is to withdraw the monitor in-system programming mode, the process is jumped back to step (a). When the write command is to rewrite the functions, the process goes to subsequent step (d), and when the write command is to rewrite the fonts, a subsequent step (e) is proceeded. In step (d), a write data is read and written into a memory, and the step (c) is followed. In step (e), an on-screen display circuit in system programming mode is set. In step (f), the fonts are read and written into a font memory. In step (g), the write command is read and written, and the step (f) is proceeded afterwards when the write command is to rewrite the fonts, or the step (e) is proceeded when the write command is to withdraw the on-screen display circuit in system programming mode.

Both the foregoing general description and the following detailed description are exemplary and explanatory only and are not restrictive of the invention, as claimed.

DESCRIPTION OF THE PREFERRED EMBODIMENTS

Figure 1:
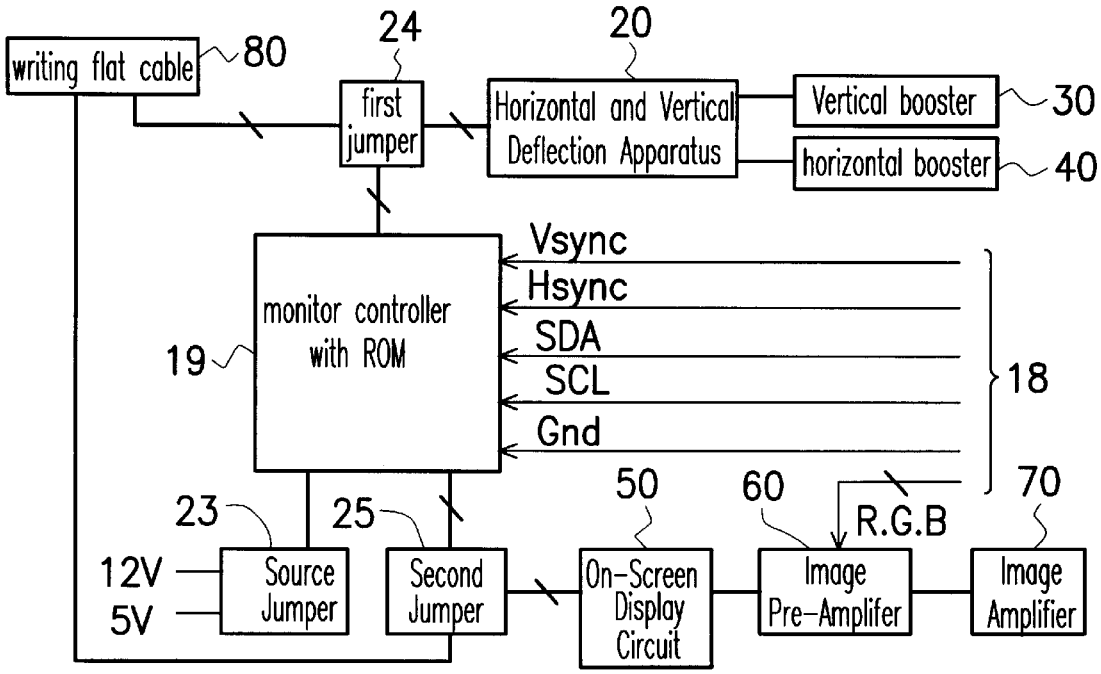
FIG. 1 (PRIOR ART)
FIG. 1 shows circuit block diagram of a conventional function-rewritable monitor system.
Figure 2:
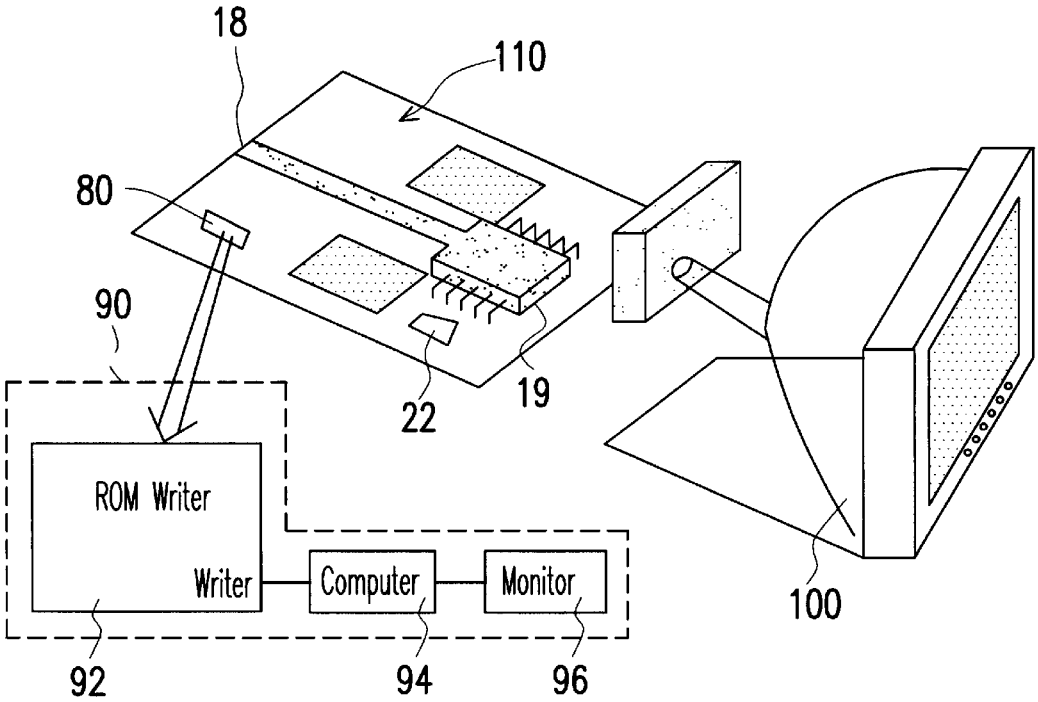
FIG. 2 (PRIOR ART)
FIG. 2 shows a block diagram of a monitor in a conventional function rewritable monitor system.
Figure 3:
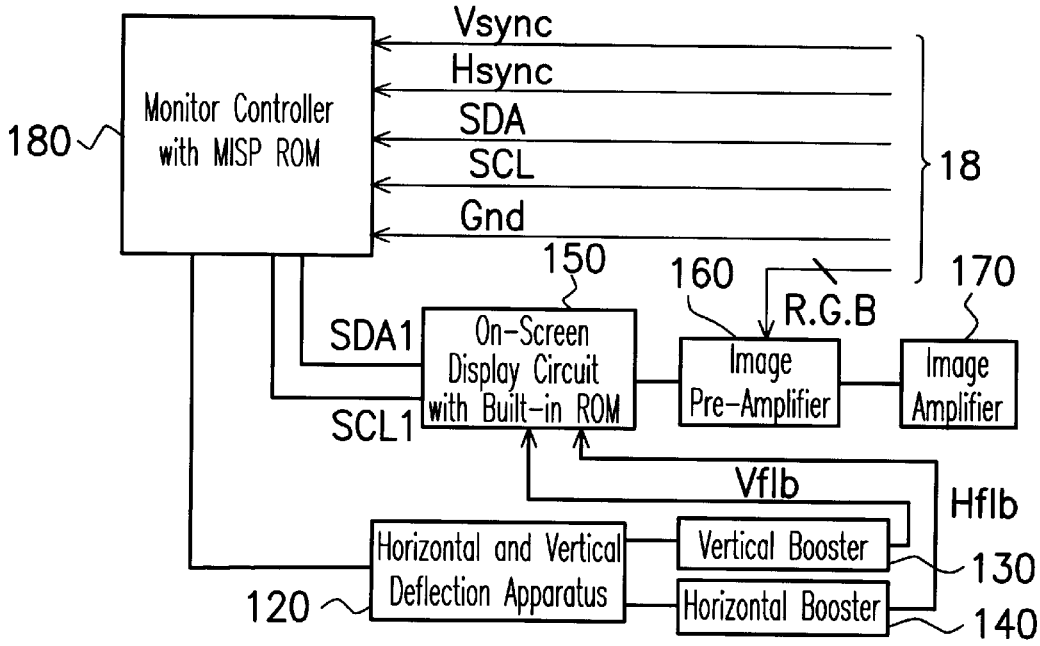
FIG. 3 shows a circuit diagram of a function rewritable monitor system according to the invention.

According to the invention, FIG. 3 shows a circuit block diagram of a monitor system of which the functions is rewritable. The VGA signal lines 18 are coupled to the monitor controller with monitor in system programming (MISP) read only memory (ROM) 180. According to the received signals and by applying the program stored in the ROM, the horizontal and vertical deflection apparatus 120 is driven to control the vertical booster 130 and the horizontal booster 140 as the vertical and horizontal controls of the CRT.

According to the invention, when the functions of the monitor system is rewritten, the data of the ROM in the monitor controller with MISP ROM 180 is to be modified. For the font modification, the font data of the ROM built in the on-screen display circuit with built-in ROM 150 is rewritten. Compared to the prior art, without opening the enclosure of the monitor, the functions of the monitor system are refreshed using the VGA signal lines 18.

Figure 4:
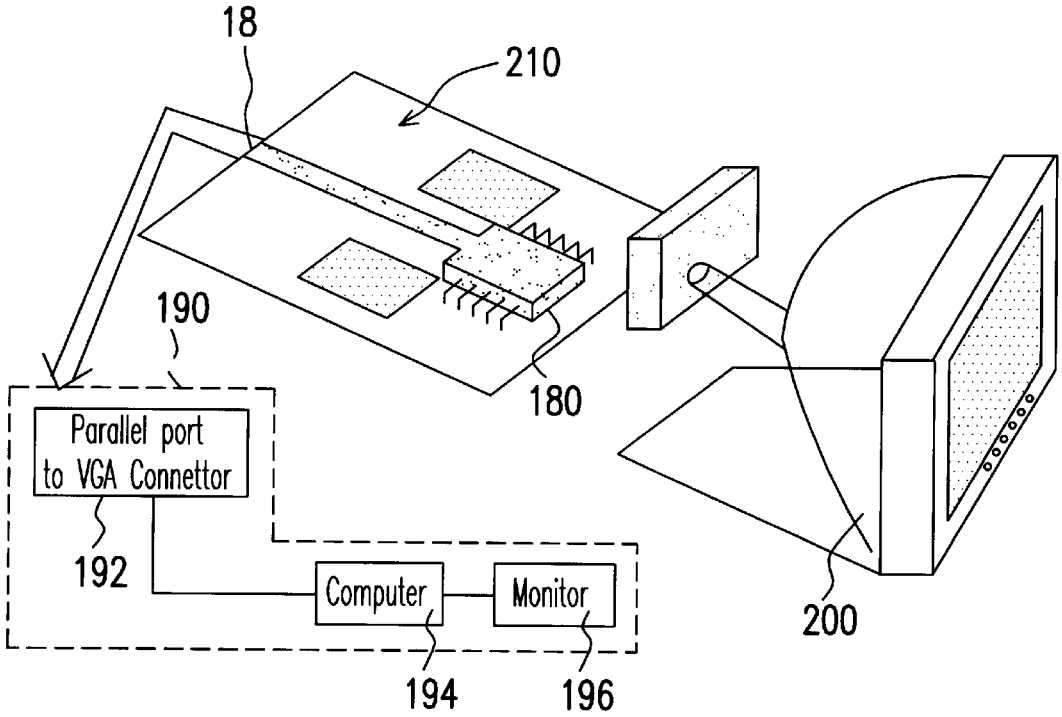
FIG. 4 shows a block diagram of a monitor in a function-rewritable monitor system according to the invention.

FIG. 4 is a block diagram showing-a monitor of which the functions and fonts can be rewritten. On a main circuit board 210 in a monitor 200, the VGA signal lines 18 are coupled to the writing apparatus 190. Being written in the computer 194, the-write command and the write data are converted in a form of inter-integrated circuit (IIC) interface. Via a parallel port to VGA connector 192, the write command and the write data are written into the ROM in the monitor controller with MISP ROM 180 of the monitor system for data modification. Or alternatively, the write command and the write data are written into the ROM of the on-screen display circuit with built-in ROM 150 for font data modification.

The write apparatus also employs another kind of IIC interface circuit platform. The write command and data are written to a memory area of the IIC interface circuit platform, followed by being written in the IIC interface form via the VGA signal lines to achieve the data modification of the ROM.

In this embodiment, the serial data line (SDA) and the serial clock line (SCL) signals within the VGA signal lines transfer the write command and data in a form of IIC interface. In the practical application, using any two of the signal lines SDA, SCL, Hsync and Vsync, the write command and data in the IIC form can be transferred to achieve the functions of data modification of the ROM.

Figure 5:
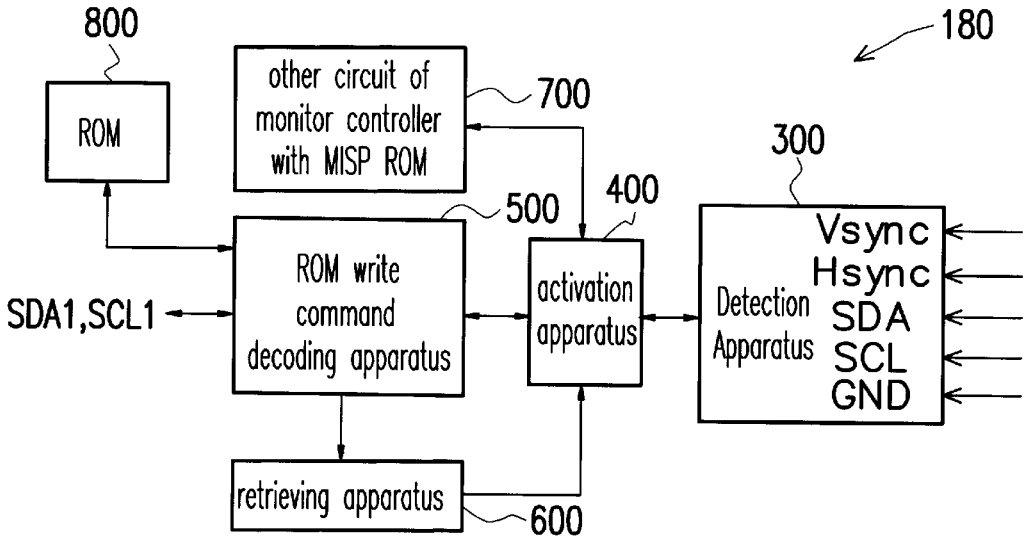
FIG. 5 shows a block diagram of a monitor controller with monitor in system programming read only memory according to the invention.

FIG. 5 is a block diagram showing a monitor controller with MISP ROM. The monitor controller with MISP ROM (180 as shown in FIG. 4) comprises a detection system 300, and activation apparatus, a ROM write command decoding apparatus 500, a retrieving apparatus 600, other circuit of monitor controller with MISP ROM 700 and a ROM 800.

The detection apparatus 300 is coupled to the VGA signal lines with the function to detect whether there is any write command and data transferred from the VGA signal lines. The signals are then sent to the activation apparatus 400.

The activation 400 comprises a set of vision paths and a set of write paths. While performing a writing operation, the activation apparatus 400 send the write command and data to the ROM write command decoding apparatus 500 via the write paths until the data in the ROM 800 are all written. Under a normal operation, the vision data are switched to the vision paths and transferred to other circuit of monitor controller with MISP ROM 700 by the activation apparatus 400 for image processing of monitor.

The ROM write command decoding apparatus 500 determines whether the received write command is a function modification or a font modification. When the write command is a font modification, the write command and the write data are output from another set of IIC circuit (SDA1 and SCL1). When the write command is a function modification, the write command is converted into an erase/read/write signal of the ROM 800, and the write data is converted to a address signal and data signal to be sent to the ROM 800 for refreshing.

The ROM 800 comprises a flash memory or an electrically erasable programmable read only memory ($E^2$PROM). The data stored in the ROM 800 are the data to execute the functions of the monitor. According to the received address signal, data signal and the erase/read/write signal, the data of the ROM 800 is refreshed.

The retrieving apparatus 600 is coupled to the ROM write command decoding apparatus 500 and the activation apparatus 400. According to the address signal, the data signal and the erase/read/write signal, the refreshing state of the ROM 800 is determined. After refreshing, the activation apparatus 400 is controlled to switch the write paths to the vision path.

A detailed description for each of the apparatus is further introduced as follows.

Figure 6:
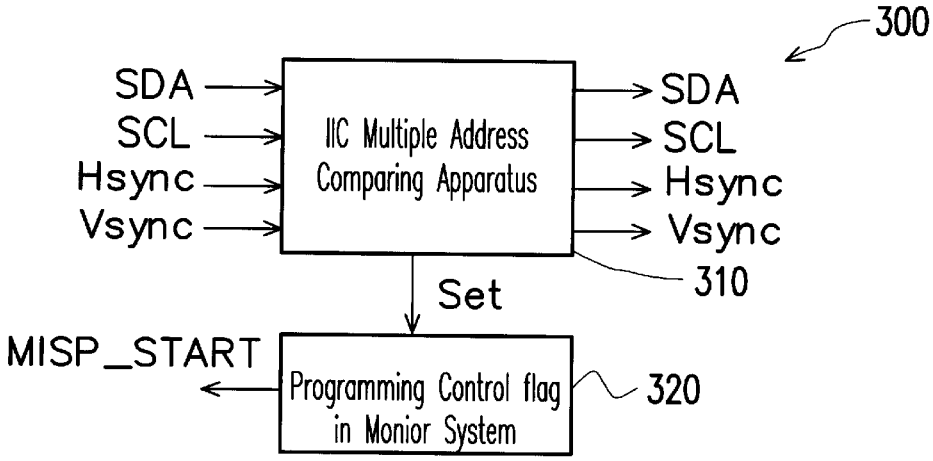
FIG. 6 shows a detection apparatus according to the invention.

In FIG. 6, the detection apparatus is illustrated. The IIC multiple address comparing circuit 310 in the detection apparatus 300 is used to compare the sequential series address of the SDA signal, and to output a set signal to a MISP flag 320 when the comparison is correct. While receiving the set signal, the MISP flag 320 is in a mode of MISP for performing a write function, and to output a MISP_START signal to the activation apparatus 400.

Figure 7:
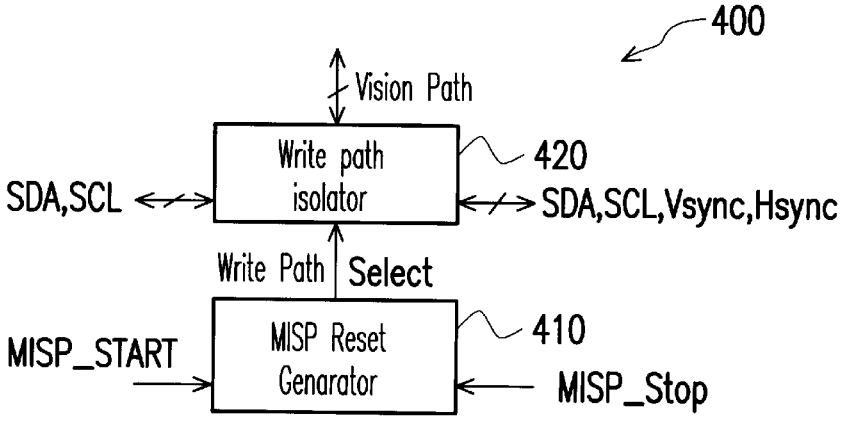
FIG. 7 shows an activation apparatus of the invention.

FIG. 7 shows the activation apparatus. When the MISP reset generator 410 receives the MISP_START signal, a select signal is generated to a write path isolator 420, The write path isolator outputs write command and data.

Figure 8:
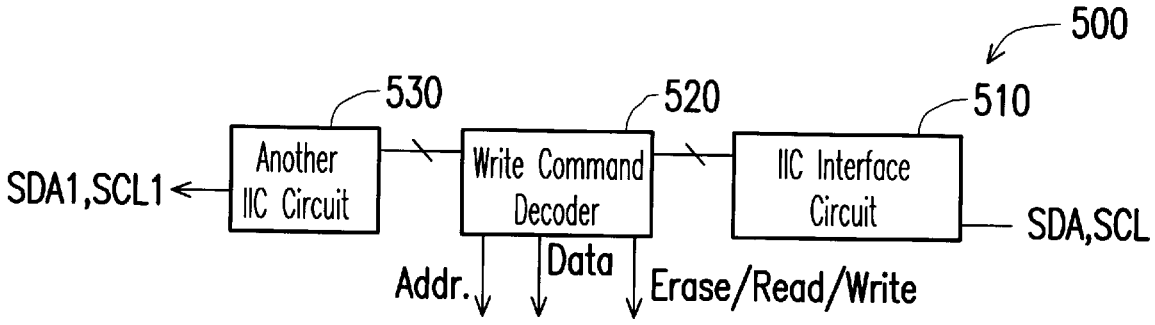
FIG. 8 shows a diagram for decoding a write command of a read only memory.

In FIG. 8, the ROM write command decoding apparatus is illustrated. The ROM write command decoding apparatus comprises an IIC interface circuit 510 to receive the write command and data from the activation apparatus, and send the write command and data to a write command decoder 520. According to the received write command, the write command decoder 520 determines whether the received write command is a function modification or a font modification command. When the write command is a font modification command, the write command and data are output from another set of IIC circuit 530 (SDA1 and SCL1). When the write command is a function modification command, the write command decoder 520 receives and converts the write command and data into address signal, data signal and erase/read/write signal to the ROM to achieve refreshing the ROM.

Figure 9:
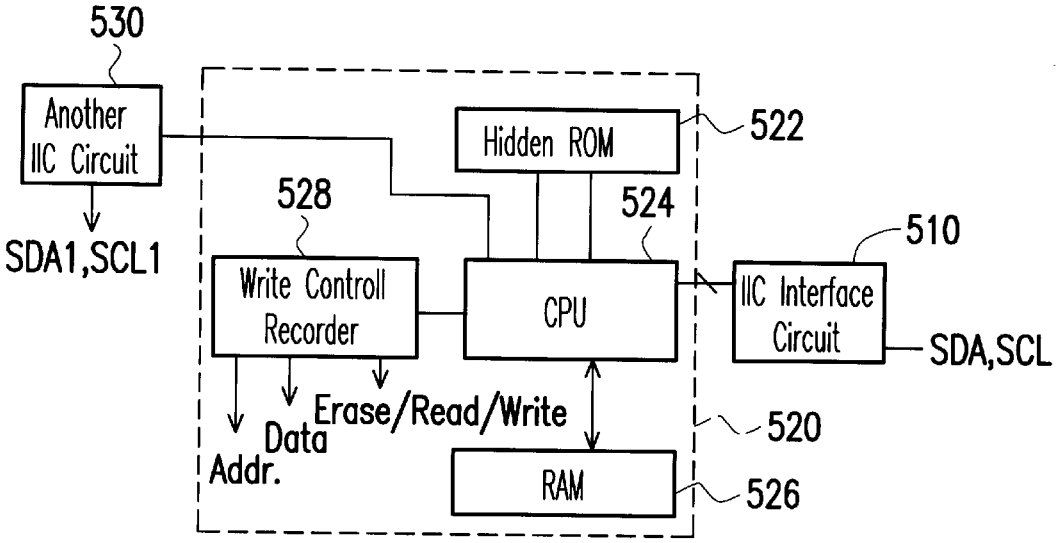
FIG. 9 shows a schematic drawing of a writing command decoder.

In FIG. 9, the write command decoder is illustrated. The write command decoder comprises a hidden ROM 522, a random access memory (RAM) 526, a central processing unit (CPU) 524 and a write control recorder 528.

The hidden ROM 522 is to store the program of the write command. The RAM is to access the write data. The CPU determines whether the received write command is a function rewriting command or a font rewriting command. When the write command is a font rewriting (modification) command, the write command and data are output from another set of IIC circuit 530 (SDA1 and SCL1). When the write command is a function rewriting command, the CPU receives the write command and data from the IIC interface circuit 510. The write data is stored in the RAM, while the write command is decoded according to the program stored in the hidden ROM 522 and sent to the write control recorder 528. When the write control recorder 528 receives the write command, the write command is converted into the erase/read/write signal. The CPU converts the write command stored in the RAM 526 into output address and data signals.

The write command decoder 520 can be established by hardware circuitry. By distinguishing the received write command into different states via the IIC interface circuit 510, the function of decoding can be achieved. When the write command is decoded as a font rewriting command, the write command and the write data are output from another set of IIC circuit 530 (SDA1 and SCL1). When the write command is decoded into a function rewriting command, the write command and data are converted into the erase/read/write signal, the address signal and the data signal to be output.

Figure 10:
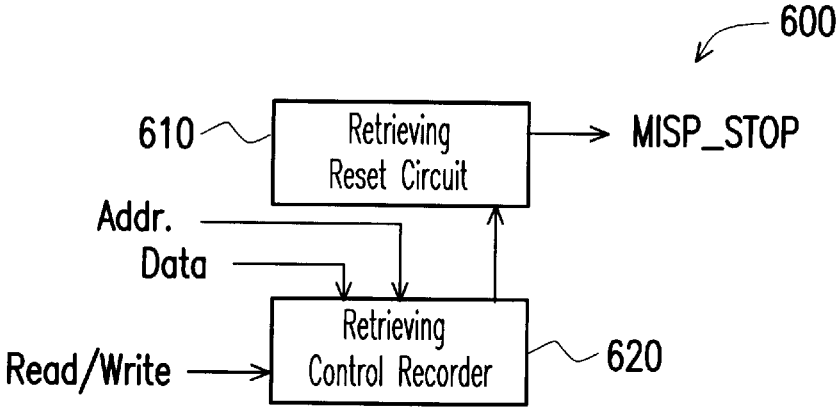
FIG. 10 shows a retrieving apparatus in the invention.

FIG. 10 shows the block diagram of the retrieving apparatus. A retrieving recorder 620 is to receive the address signal, data signal and the erase/read/write signal, and to output a retrieve signal to the retrieving reset circuit 610. When the retrieving reset circuit 610 receives the retrieve signal, a MISP_STOP signal is output to the activation apparatus 400, so as to switch the write path to the vision path.

According to the invention, the on-screen display circuit 150 with built-in ROM is coupled to the signal lines SDA1 and SCL1 of another set of IIC circuit 520, the Vflb signal line of the vertical booster 130, and the Hflb signal line of the horizontal booster 140.

Figure 11:
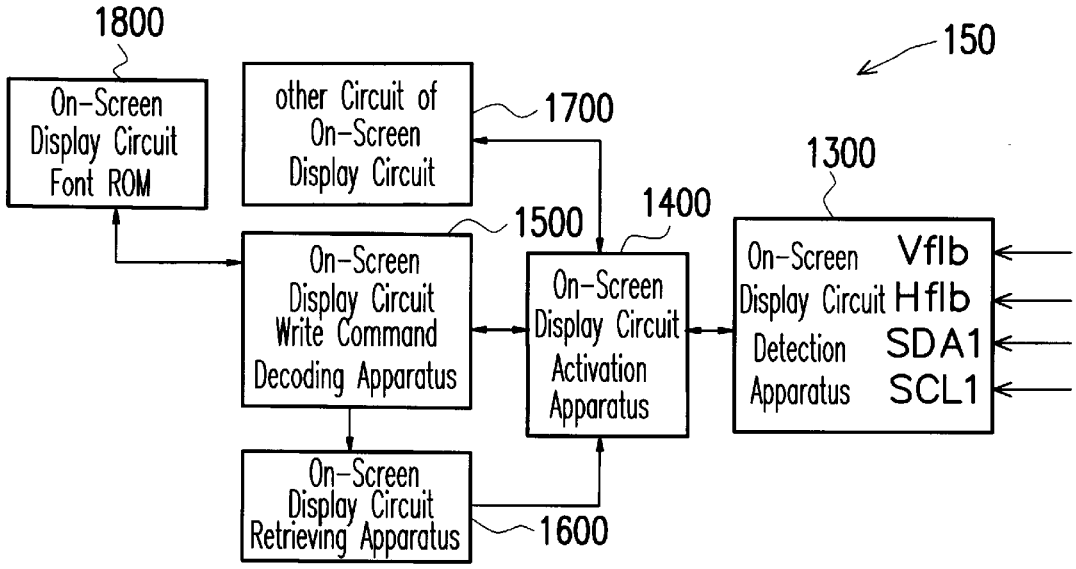
FIG. 11 is a block diagram showing the on-screen display circuit of read only memory with built-in fonts.

FIG. 11 shows a circuit diagram of the on-screen display circuit with built-in ROM. The on-screen display circuit with built-in ROM 150 comprises an on-screen display circuit detection apparatus 1300, an on-screen display circuit activation apparatus 1400, an on-screen display circuit write command decoding apparatus 1500, an on-screen display circuit retrieving apparatus, other circuit of on-screen display circuit 1700 and an on-screen display circuit font ROM 1800.

The on-screen display circuit detection apparatus 1300 coupled to the signal lines Vflb, Hflb, SDA1 and SCL1 is to detect whether there are write command and data sent from another set of the IIC circuit. Thereafter, the signal is sent to the on-screen display circuit activation apparatus 1400.

The on-screen display circuit activation apparatus 1400 comprises a set of signal path and a set of font write path. While writing, the on-screen display circuit activation apparatus 1400 sends the write command and data to the on-screen display circuit write command decoding apparatus 1500 via the font write path, until all the data of the on-screen display circuit font ROM 1800 are written. Under a normal operation, the signal data (SDA, SCL, Vflb, Hflb) are sent to other circuit 1700 of the on-screen display circuit by means of switching to the signal path via the on-screen display circuit activation apparatus 1400.

The on-screen display circuit write command decoding apparatus 1500 is to receive the write command, so as to convert the write command into the erase/read/write command of the on-screen display circuit font ROM 1800. Furthermore, the on-screen display circuit write command decoding apparatus converts the write data into address signal and data signal of the on-screen display circuit font ROM 1800 for refreshing.

The on-screen display circuit font ROM 1800 comprises a flash ROM or an $E^2$PROM. The data stored in the on-screen display circuit font ROM 1800 is used as the font display data of the monitor. The on-screen display circuit font ROM 1800 achieves refreshing the data of the on-screen display circuit font ROM 1800 according to the address signal, the data signal and the erase/read/write signal.

The on-screen display circuit retrieving apparatus 1600 is coupled to the onscreen display circuit write command decoding apparatus 1500 and the on-screen display circuit activation apparatus 1400. According to the address signal, the data signal and the erase/read/write signal, the on-screen display circuit retrieving apparatus 1600 to determine the refreshing state of the data stored in the on-screen display circuit font ROM 1800. After refreshing, the on-screen display circuit activation apparatus 1400 is controlled to switch the font write path to the signal path.

The apparatus is further described as follows.

Figure 12:
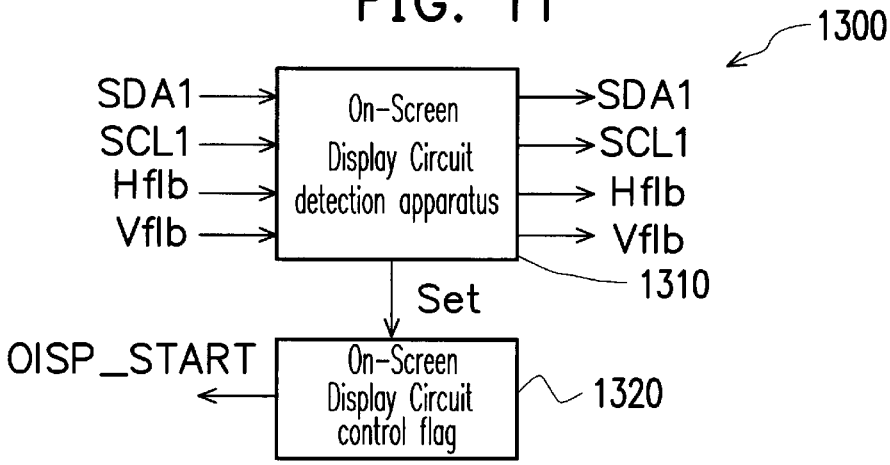
FIG. 12 schematically illustrates the on-screen display circuit detection apparatus.

In FIG. 12, the on-screen display circuit detection apparatus is illustrated. An on-screen display circuit IIC multiple address comparing apparatus 1310 in the on screen display circuit detection apparatus 1300 is to compare the sequential series address of the SDA1 signal line, and to send an on-screen display circuit set signal to an on-screen display circuit control flag 1320 when the comparison is correct. When the on-screen display circuit control flag 1320 receives the on-screen display circuit set signal, it indicates to be an on-screen display circuit system in on-screen display circuit in-system programming mode for performing a write function, and a OISP_START signal for starting programming is sent to the on-screen display circuit activation apparatus 1400.

Figure 13:
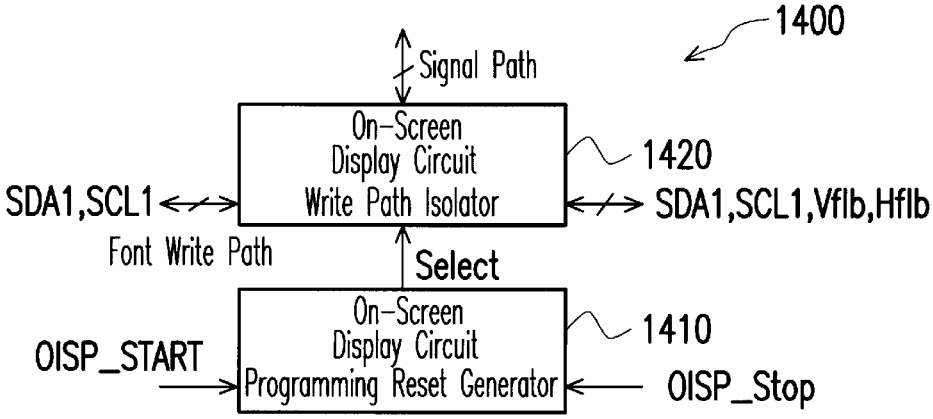
FIG. 13 schematically illustrates the on-screen display circuit activation apparatus.

FIG. 13 shows the layout of the on-screen display circuit activation apparatus. When the on-screen display circuit in-system programming reset generator 1410 receives the OISP_START signal, an on-screen display circuit select signal (SELECT) is generated to an on-screen display circuit write path isolator 1420. The on-screen display circuit write path isolator 1420 switches the signal path to the font write path, and outputs the write command and data via the font write path.

Figure 14:
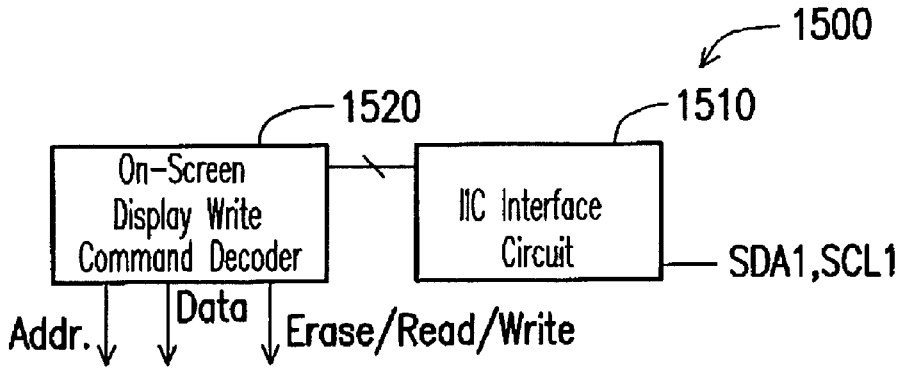
FIG. 14 schematically illustrates the circuit write command decoding apparatus.

FIG. 14 shows the on-screen display circuit write command decoding apparatus. The on-screen display circuit write command decoding apparatus 1500 comprises an IIC interface circuit 1510 to receive the write command and data from the on-screen display circuit activation apparatus 1400. The IIC interface circuit then sends the write command and data to an on-screen display circuit write command decoder 1520. The on-screen display circuit write command decoder 1520 receives and converts the write command and data into address signal, data signal and erase/read/write signal. The address signal, data signal and the erase/read/write signal are sent to the on-screen display circuit font ROM to refresh the on-screen display circuit font ROM.

Figure 15:
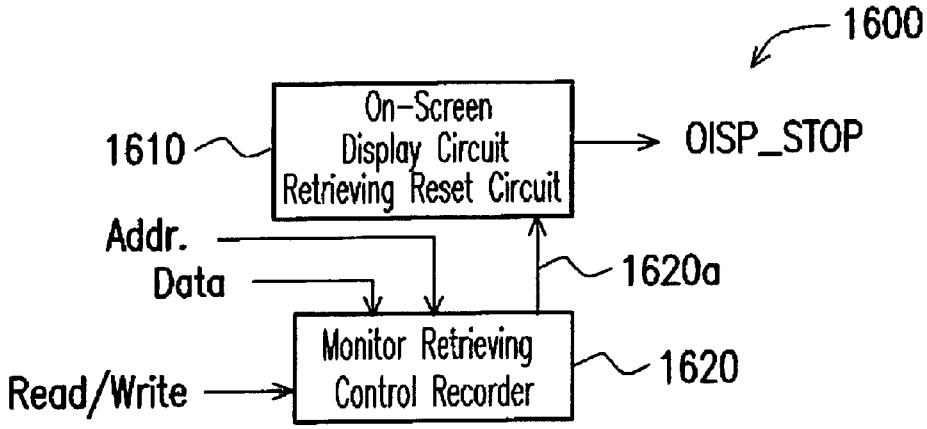
FIG. 15 shows the on-screen display circuit retrieving apparatus.

FIG. 15 shows the on-screen display circuit retrieving apparatus. The on-screen display circuit retrieving apparatus receives the address signal, the data signal and the erase/read/write signal through a monitor retrieving control recorder 1620 and output an on-screen display circuit retrieving signal 1620*a* to the on-screen display circuit retrieve reset circuit 1610 after writing. The on-screen display circuit retrieve reset circuit 1610 outputs OISP_STOP signal for stopping programming to the on-screen display circuit activation apparatus 1400 and switches the font write path into the signal path while receiving the on-screen display retrieving signal.

Figure 16:
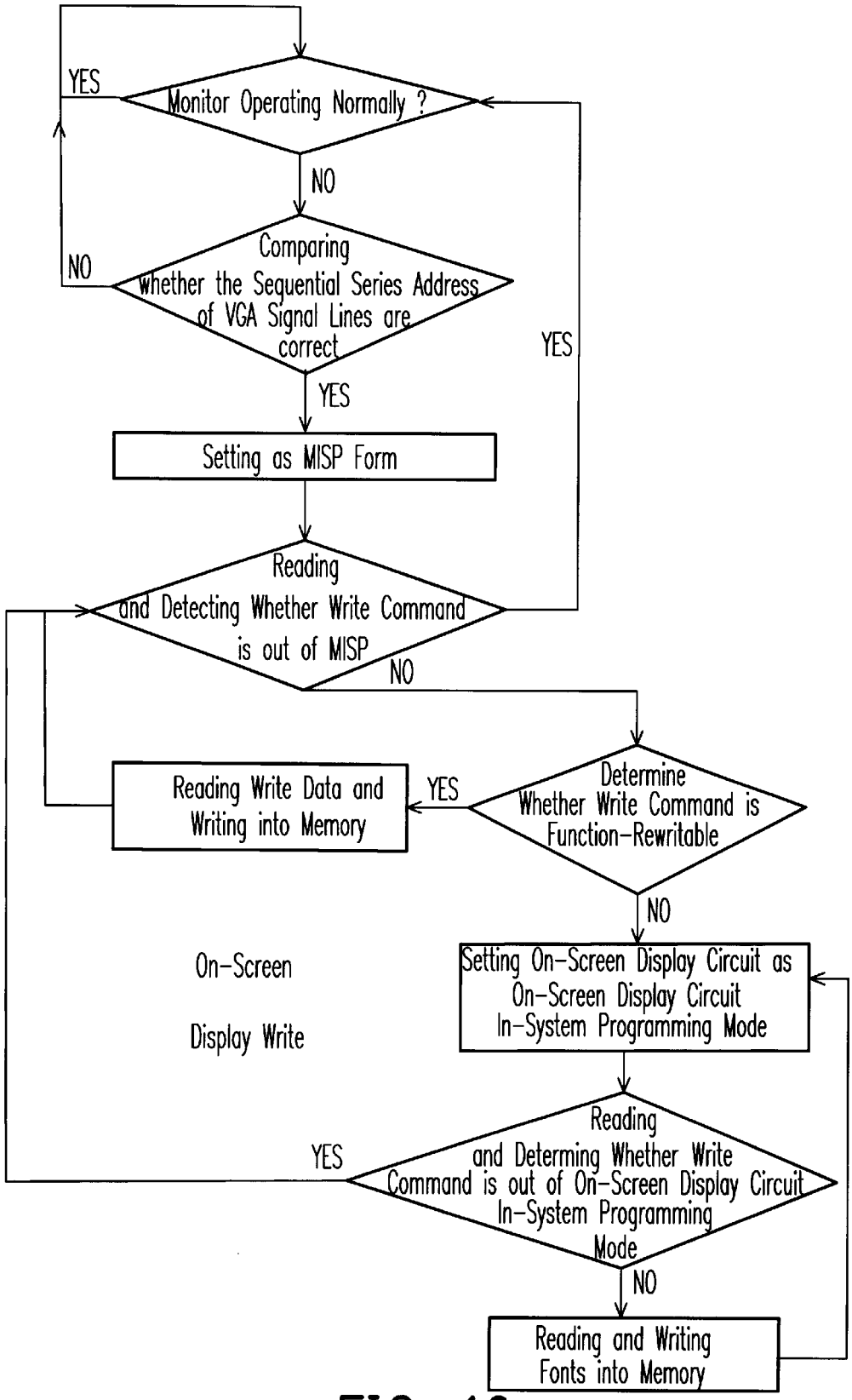
FIG. 16 shows the method for rewriting the functions and fonts of the monitor.

The method for rewriting functions of the monitor is illustrated as FIG. 16. In a first step, detection is performed on the monitor to make sure that the monitor is under normal operating state. If the monitor is not operated properly, a comparison for sequential address series of signals of the VGA signal lines is performed. When the comparison is different, it is treated as a normal vision transmission mode and a previous step proceeded. When the comparison of the sequential address series is identical, a MISP mode is set.

In the next step, the write command is read and examined to determine whether the MISP mode is withdrawn. When the write command is to withdraw the MISP mode, the process goes back to the step for detecting whether the monitor works normally.

When the write command is not to withdraw from the MISP mode, but is to modify the function, the write data is read and written into the memory.

When the write command is not to withdraw from the MISP mode, neither to rewrite the function, an on-screen display circuit in-system programming mode is set.

Whether the write command is to withdraw from the on-screen display circuit in-system programming mode is read and judged. When the write command is to withdraw from the on-screen display circuit in-system programming mode, the process goes back to the step of determining whether the MISP mode is to be withdrawn.

If the write command indicates that the on-screen display circuit in-system programming mode is not to be withdrawn, the write data is read and the fonts are written into the memory.

Thus, the invention provides an apparatus and a method for rewriting functions and fonts of a monitor. By directly connecting the monitor with a VGA card, and via the VGA signal line to transmit and write the programming font data of the on-screen display controller to the $E^2$PROM, the data refresh can be achieved.

Other embodiments of the invention will appear to those skilled in the art from consideration of the specification and practice of the invention disclosed herein. It is intended that the specification and examples to be considered as exemplary only, with a true scope and spirit of the invention being indicated by the following claims.

What is claimed is:

1. An apparatus for rewriting functions and fonts of a monitor, comprising:

a VGA signal line, to transmit a plurality of write commands and a plurality of write data;

a detection apparatus, coupled to the VGA signal line to detect the output write commands and write data;

an activation apparatus, coupled to the detection apparatus to switch a vision path to a write path, to receive the write commands and write data, and to output the write commands and write data via the write path;

a read-only memory write command decoding apparatus, coupled to the activation apparatus via the write path, the read-only memory write command decoding apparatus judging the write commands and output the write commands and write data when the write commands are font rewriting, and transferring the write commands into a plurality of erase/read/write signal and the write data into a plurality of address signals and a plurality of data signals when the write commands are function rewriting;

a read-only memory, coupled to the read-only memory write command decoding apparatus, to refresh data stored therein according to the address signals, the data signals and the erase/read/write signals;

a retrieving apparatus, coupled to the read-only memory write command decoding apparatus and the activation apparatus, so as to determine the refresh status of the read-only memory according to the address signals, the data signals and the erase/read/write signals, and to switch the write path into vision path after refreshing;

a set of IIC circuit, coupled to the read-only memory write command decoding apparatus, to receive the write commands and write data during font rewriting;

an on-screen display circuit detection apparatus, coupled to the set of IIC circuit, to detect and output the write commands and the write data;

an on-screen display circuit activation apparatus, coupled to the on-screen display circuit detection apparatus, to switch the vision path into a font write path, to receive the write commands and the write data, and to output the write commands and the write data via the font write path;

an on-screen display circuit write command decoding apparatus, coupled to the on-screen display circuit activation apparatus via the font write path, transferring the write commands into a plurality of erase/read/write signals, and transferring the write data into a plurality of address signals and a plurality of data signals;

an on-screen display circuit font read-only memory, coupled to the on-screen display circuit write command decoding apparatus, to refresh data stored therein according to the address signals, the data signals and the erase/read/write signals; and an on-screen display circuit retrieving apparatus, coupled to the on-screen display circuit write command decoding apparatus and the on-screen display circuit activation apparatus, to judge the refreshing status of the data stored in the read-only memory according to the address signals, the data signals and the erase/read/write signals.

2. The apparatus according to claim 1, wherein VGA signal line is coupled to a write apparatus to transmit the write commands and the write data.

3. The apparatus according to claim 2, wherein write apparatus comprises a computer platform to transmit the write commands and the write data in a form of an IIC interface via a parallel port to a VGA connector.

4. The apparatus according to claim 2, wherein the write apparatus comprises an IIC circuit platform to transmit the write commands and the write data in a form of an IIC interface.

5. The apparatus according to claim 1, comprising further:

an IIC multiple address comparing apparatus, coupled to the VGA signal line, to compare a plurality of sequential series address of the write data, and to output a set signal while the comparing result is correct; and a monitor in-system programming control flag, coupled to the IIC multiple address comparing apparatus, to output a monitor in-system programming starting signal according to the set signal.

6. The apparatus according to claim 1, comprising further:

a monitor in-system programming reset circuit, to generate a select signal according to the monitor in-system programming starting signal; and a write path isolator, to switch the vision path to the write path according to the select signal, and to output the write commands and the write data via the write path.

7. The apparatus according to claim 1, wherein the read-only memory write command decoding apparatus comprises:

an IIC interface circuit, to receive and transfer the write commands and write data; and a write command decoder, to receive the transferred write commands and write data, and to output the address signals, the data signals and the erase/read/write signals.

8. The apparatus according to claim 7, wherein the write command decoder further comprises:

a hidden read-only memory, to store programming codes of the write commands;

a random access memory, to store the write data;

a central processing unit, coupled to the hidden read only memory, the random access memory and the IIC interface circuit to receive the write commands and write data transferred by the IIC interface circuit, so as to store the write data in the random access memory, and to decode and output the write commands according the programming codes of the hidden read only memory; and a write control recorder, coupled to the central processing unit to receive the decoded write commands, and to transfer the decoded write commands into the erase/read/write signals as interface control signals of the read only memory, and to output the write data stored in the random access memory in a form of the address signals and the data signals.

9. The apparatus according to claim 7, wherein the write command decoder is formed by a hardware circuit that distinguishes the write commands received by the IIC circuit into a plurality of states to achieve the decoding function, and transfers the write commands and write data into the erase/read/write signals, the address signals and the data signals.

10. The apparatus according to claim 1, wherein the retrieving apparatus further comprises:

a retrieving control recorder, to receive the address signals, the data signals and the erase/read/write signals to output a retrieving signal after writing;

a retrieving reset circuit, coupled to the retrieving control recorder and the activation apparatus, to output a monitor in-system programming stop signal to switch the write path into the vision path of the activation apparatus while receiving the retrieving signal.

11. The apparatus according to claim 1, wherein read-only memory comprises a flash read only memory.

12. The apparatus according to claim 1, wherein the read-only memory comprises an electrical erasable programmable read only memory.

13. The apparatus according to claim 1, wherein the monitor detection apparatus further comprises:

an on-screen display circuit IIC multiple address comparing circuit, coupled to the set of IIC circuit, to compare a plurality of sequential series addresses of the write data, and to output an on-screen display circuit set signal when the comparing result is correct; and an on-screen display circuit in-system programming control flag, coupled to the IIC multiple address comparing circuit to output an on-screen display circuit in-system programming start signal according to the on-screen display circuit set signal.

14. The apparatus according to claim 1, wherein the on-screen display circuit activation apparatus further comprises:

an on-screen display circuit in-system programming reset generating circuit, to generate an on-screen display circuit select signal according to the on-screen display circuit in-system programming start signal; and an on-screen display circuit write path isolator, to switch the signal path to the font write path according to the on-screen display circuit select signal, and to output the write commands and the write data via the font write path.

15. The apparatus according to claim 1, wherein the on-screen display circuit write command decoding apparatus further comprises:

an IIC interface circuit, to receive and transfer the write commands and the write data; and an on-screen display circuit write command decoder, to received the transferred write commands and write data, and to output the address signals, the data signals and the erase/read/write signals.

16. The apparatus according to claim 15, wherein the write command decoder is formed by a hardware circuit that distinguishes the write commands received by the IIC circuit into a plurality of states to achieve the decoding function, and transfers the write commands and write data into the erase/read/write signals, the address signals and the data signals.

17. The apparatus according to claim 1, wherein the on-screen display circuit retrieving apparatus further comprises:

an on-screen display circuit retrieving control recorder, coupled to the address signals, the data signals and the erase/read/write signals to output an on-screen display circuit retrieving signal after writing; and an on-screen display circuit retrieving reset circuit, coupled to the on-screen display circuit retrieving control recorder and the on-screen display circuit activation apparatus, so as to output an on-screen display circuit in-system programming stop signal to switch the font write path into the signal path while receiving the on-screen display circuit retrieving signal.

18. The apparatus according to claim 1, wherein the on-screen display circuit read only memory comprises a flash read only memory.

19. The apparatus according to claim 1, wherein the on-screen display circuit read only memory comprises an electrical erasable programmable read only memory.

20. An apparatus for rewriting functions and fonts of a monitor, comprising:

a VGA signal line, to transmit a plurality of write commands and a plurality of write data;

a set of IIC circuit, coupled to the VGA signal line to receive the write commands and the write data while rewriting the fonts;

an on-screen display circuit activation apparatus, coupled to the on-screen display circuit detection apparatus to switch a signal path into a font write path, to receive the write commands and the write data and to output the write commands and the write data via the font write path;

an on-screen display circuit write command decoding apparatus, coupled to the on-screen display circuit activation apparatus to transfer the write commands into a plurality of erase/read/write commands, and to transfer the write data into a plurality of address signals and a plurality of data signals;

an on-screen display circuit font read only memory, coupled to the on-screen display write command decoding apparatus, to refresh data stored in the on-screen display circuit read only memory according to the address signals, the data signals and the erase/read/write signals; and an on-screen display circuit retrieving apparatus, coupled to the on-screen display circuit write command decoding apparatus and the on-screen display circuit activation apparatus, to judge the refreshing status of the data stored in the on-screen display circuit read only memory according to the address signals, the data signals and the erase/read/write signals, and to switch the font write path into the signal path by controlling the on-screen display circuit activation apparatus after refreshing.

21. The apparatus according to claim 20, wherein the VGA signal is coupled to a write apparatus to transmit the write commands and the write data.

22. The apparatus according to claim 21, wherein write apparatus comprises a computer platform to transmit the write commands and the write data in a form of an IIC interface via a parallel port to a VGA connector.

23. The apparatus according to claim 21, wherein the write apparatus comprises an IIC circuit platform to transmit the write commands and the write data in a form of an IIC interface.

24. The apparatus according to claim 20, comprising further:

an on-screen display circuit IIC multiple address comparing circuit, coupled to the set of IIC circuit, to compare a plurality of sequential series addresses of the write data, and to output an on-screen display circuit set signal when the comparing result is correct; and an on-screen display circuit in-system programming control flag, coupled to the IIC multiple address comparing circuit to output an on-screen display circuit in-system programming start signal according to the on-screen display circuit set signal.

25. The apparatus according to claim 20, wherein the on-screen display circuit activation apparatus further comprises:

an on-screen display circuit in-system programming reset generating circuit, to generate an on-screen display circuit select signal according to the on-screen display circuit in-system programming start signal; and an on-screen display circuit write path isolator, to switch the signal path to the font write path according to the on-screen display circuit select signal, and to output the write commands and the write data via the font write path.

26. The apparatus according to claim 20, wherein the on-screen display circuit write command decoding apparatus further comprises:

an IIC interface circuit, to receive and transfer the write commands and the write data; and an on-screen display circuit write command decoder, to received the transferred write commands and write data, and to output the address signals, the data signals and the erase/read/write signals.

27. The apparatus according to claim 26, wherein on-screen display circuit write command decoder further comprises:

a hidden read-only memory, to store programming codes of the write commands;

a random access memory, to store the write data;

a central processing unit, coupled to the hidden read only memory, the random access memory and the IIC interface circuit to receive the write commands and write data transferred by the IIC interface circuit, so as to store the write data in the random access memory, and to decode and output the write commands according the programming codes of the hidden read only memory; and a write control recorder, coupled to the central processing unit to receive the decoded write commands, and to transfer the decoded write commands into the erase/read/write signals as interface control signals of the read only memory, and to output the write data stored in the random access memory in a form of the address signals and the data signals.

28. The apparatus according to claim 20, wherein the on-screen display circuit retrieving apparatus further comprises:

an on-screen display circuit retrieving control recorder, coupled to the address signals, the data signals and the erase/read/write signals to output an on-screen display circuit retrieving signal after writing; and an on-screen display circuit retrieving reset circuit, coupled to the on-screen display circuit retrieving control recorder and the on-screen display circuit activation apparatus, so as to output an on-screen display circuit in-system programming stop signal to switch the font write path into the signal path while receiving the on-screen display circuit retrieving signal.

29. The apparatus according to claim 20, wherein the on-screen display circuit read only memory comprises a flash read only memory.

30. The apparatus according to claim 20, wherein the on-screen display circuit read only memory comprises an electrical erasable programmable read only memory.

31. A method of rewriting functions and fonts of a monitor, comprising:

(a) performing a comparison of a plurality of sequential series addresses on a plurality of signals of a VGA signal line;

(b) setting a monitor in-system programming mode when the comparison of the sequential series addresses is correct;

(c) reading and judging a write command, going back to the step (a) when the write command is to withdraw the monitor in-system programming mode, going to a subsequent step (d) when the write command is to rewrite the functions, and go to a subsequent step (e) when the write command is to rewrite the fonts;

(d) reading and writing a write data into a memory, and to go to step (c);

(e) setting an on-screen display circuit in-system programming mode;

(f) reading and writing the fonts into a font memory; and (g) reading the write command, and going to step (f) when the write command is to rewrite the fonts, and to go to the step (e) when the write command is to withdraw the on-screen display circuit in-system programming mode.

32. The method according to claim 31, wherein the method is performed when the monitor is operated under abnormal state.

33. The method according to claim 31, wherein when the comparison is incorrect, the sequential series addresses are in a normal vision transmitting mode.

* * * * *